US011654465B2

(12) United States Patent
Ben Amor et al.

(10) Patent No.: US 11,654,465 B2
(45) Date of Patent: May 23, 2023

(54) METHOD FOR PRODUCING A BLANK FROM EXTRUSION MATERIAL, AND EXTRUDER

(71) Applicant: Kennametal Inc., Latrobe, PA (US)

(72) Inventors: Raouf Ben Amor, Fuerth (DE); Augustin Donhardt, Hummeltal (DE); Tim Guter, Fuerth (DE); Bjoern Hoschke, Essen (DE); Guenther Hoyer, Essen (DE); Herbert Rudolf Kauper, Fuerth (DE); Klaus Roediger, Bochum (DE); Fabian Rosenberger, Latrobe, PA (US); Jürgen Schwägerl, Vohenstrauss (DE)

(73) Assignee: Kennametal Inc., Latrobe, PA (US)

( * ) Notice: Subject to any disclaimer, the term of this patent is extended or adjusted under 35 U.S.C. 154(b) by 293 days.

(21) Appl. No.: 16/285,906

(22) Filed: Feb. 26, 2019

(65) Prior Publication Data

US 2019/0262879 A1 Aug. 29, 2019

(30) Foreign Application Priority Data

Feb. 27, 2018 (DE) ..... 102018202941.5

(51) Int. Cl.
*B21C 23/14* (2006.01)
*B21C 25/08* (2006.01)
*B21C 25/02* (2006.01)

(52) U.S. Cl.
CPC ..... *B21C 23/147* (2013.01); *B21C 25/02* (2013.01); *B21C 25/08* (2013.01)

(58) Field of Classification Search
CPC ..... B21C 25/02; B21C 25/06; B21C 25/08; B21C 23/14; B21C 23/142; B21C 23/147
(Continued)

(56) References Cited

U.S. PATENT DOCUMENTS 3,555,935 A * 1/1971 Dorrenberg ..... B21C 23/085 76/108.6
5,557,962 A * 9/1996 Takikawa ..... B21C 23/14 72/260

(Continued)

FOREIGN PATENT DOCUMENTS

CN 103128117 A 4/2016
DE 3636798 A1 * 4/1988 ..... B21C 23/147

(Continued)

OTHER PUBLICATIONS

Nov. 7, 2018 Foreign OA.
Jul. 13, 2021 Office Action (non-US) DE App. No. 102018202941.
May 7, 2022 Office Action (non-US) CN App. No. 110193604.

*Primary Examiner* — Adam J Eiseman
*Assistant Examiner* — Bobby Yeonjin Kim
(74) *Attorney, Agent, or Firm* — Christopher J. Owens

(57) ABSTRACT

The invention relates to a method for producing a blank, in particular a blank for the production of a cutting tool, wherein a green body extending in the direction of the extrusion axis is produced from extrusion material by means of an extruder which has an extrusion channel extending along an extrusion axis; wherein the extrusion channel together with a movable mold element forms a die of the extruder; and wherein the mold element is moved relative to the extrusion channel and within said extrusion channel during the extrusion of the green body, whereby the shaping geometry of the die is changed so that the completely extruded green body hereby has a first functional segment and a second functional segment adjacent thereto in the direction of the extrusion axis (4); wherein the two functional segments differ with regard to their geometries impressed by the die.

19 Claims, 8 Drawing Sheets

(58) Field of Classification Search
USPC ..... 72/256, 260, 264–266, 268, 270
See application file for complete search history.

(56) References Cited

U.S. PATENT DOCUMENTS

| | | | | |
|---|---|---|---|---|
| 5,601,857 | A * | 2/1997 | Friedrichs | B21C 23/147 264/209.2 |
| 5,904,939 | A | 5/1999 | Friedrichs | |
| 6,248,277 | B1 * | 6/2001 | Friedrichs | B21C 23/147 264/167 |
| 6,450,739 | B1 * | 9/2002 | Puide | B21C 23/147 408/144 |
| 6,669,414 | B1 | 12/2003 | Puide et al. | |
| 7,101,167 | B2 | 9/2006 | Puide et al. | |
| 7,296,497 | B2 | 11/2007 | Kugelberg et al. | |
| 7,340,978 | B2 | 3/2008 | Kugelberg et al. | |
| 7,371,344 | B2 | 5/2008 | Gronquist et al. | |
| 8,678,072 | B2 | 3/2014 | Shavit | |
| 8,808,591 | B2 | 8/2014 | Mirchandani et al. | |
| 2005/0047951 | A1 * | 3/2005 | Gronquist | B23P 15/32 419/41 |
| 2005/0235722 | A1 * | 10/2005 | Friedrichs | B21C 23/147 72/264 |
| 2006/0008549 | A1 | 1/2006 | Rigali et al. | |
| 2010/0272531 | A1 | 10/2010 | Shavit | |
| 2012/0079918 | A1 * | 4/2012 | Gensert | B21C 23/147 76/5.1 |
| 2013/0136550 | A1 * | 5/2013 | Kakai | B21C 23/147 408/59 |
| 2014/0097553 | A1 * | 4/2014 | Mirchandani | B22F 5/10 264/171.1 |

FOREIGN PATENT DOCUMENTS

| | | | | |
|---|---|---|---|---|
| DE | 4021383 | A1 | 1/1992 | |
| DE | 4211827 | A1 | 10/1993 | |
| DE | 4120166 | C2 | 10/1994 | |
| EP | 0431681 | A2 | 6/1991 | |
| EP | 0532598 | B1 * | 8/1995 | B21C 33/004 |
| JP | 01147006 | A * | 6/1989 | B21C 23/147 |
| JP | 04157014 | A * | 5/1992 | B21C 33/004 |
| JP | 09267208 | A * | 10/1997 | B21C 23/147 |
| WO | 2004002642 | A1 | 1/2004 | |
| WO | 2014141174 | A1 | 9/2014 | |
| WO | 2014195009 | A1 | 12/2014 | |

* cited by examiner

METHOD FOR PRODUCING A BLANK FROM EXTRUSION MATERIAL, AND EXTRUDER

RELATED APPLICATION DATA

The present application claims priority pursuant to 35 U.S.C. § 119(a) to German Patent Application No. 102018202941.5 filed Feb. 27, 2018, which is incorporated herein by reference in its entirety.

FIELD

The invention relates to a method for producing a blank, in particular a blank for the production of a cutting tool, wherein a green body extending in the direction of the extrusion axis is produced from extrusion material by an extruder, which has an extrusion channel extending along an extrusion axis.

BACKGROUND

In the production of cutting tools, green bodies are in some instances first produced from extrusion material by means of an extruder. The green bodies or green parts thus produced are subsequently subjected to a sintering process in order to produce blanks. The corresponding blanks usually have a very rough, still unfinished shape, thus for example a simple cylindrical shape or rod shape. In order to finish the cutting tools, the blanks are finally post-processed, sometimes very elaborately, wherein flutes and in some instances a cutting edge geometry are introduced into the blanks via removal methods, for example. Alternatively, such a removal of material takes place before a sintering process.

Given cutting tools produced in this way, a tool shank of a cutting tool is typically designed as a type of full cylinder or as a solid cylinder.

SUMMARY

Proceeding herefrom, the invention is based on the object of specifying an advantageous method for producing a blank from extrusion material, as well as an advantageously designed extruder.

This object is achieved according to the invention by a method with the features of claim 1 and by an extruder with the features of claim 16. Preferred developments are presented in the dependent claims. The advantages and preferred embodiments presented with regard to the method also analogously apply to the extruder and vice versa.

A corresponding method serves to produce a blank, in particular a blank for the production of a cutting tool, thus for example a drill or a reamer. In the course of the production process, a green body extending in the direction of the extrusion axis or in the direction of a longitudinal axis is hereby produced from extrusion material by means of an extruder which has an extrusion channel extending along an extrusion axis.

In doing so, among other things it is also ensured that a sufficient and in particular interference-free additional air flow is present or made possible if a cavity is produced with the extrusion material, for example in order to form a cooling channel, so that the created hollow shape subsequently remains and is not destroyed again during further extrusion.

The green body or green part thus produced is then typically processed further, wherein it is usually subjected to a sintering process in order to produce a blank, and wherein the blank is post-processed in most cases, for example by grinding, in order to finish the cutting tool.

In this instance, an extruder is used to produce the green body, the extrusion channel of which extruder together with at least one movable mold element forms a die, thus effectively a settable or adjustable die, of the extruder, wherein the mold element is moved relative to the extrusion channel and in particular within said extrusion channel during the extrusion of the green body, whereby the shaping geometry of the die is changed during the extrusion of the green body. A green body is hereby produced which has a first functional segment and a second functional segment following thereon in the direction of the extrusion axis or in the direction of the longitudinal axis of the green body, wherein the functional segments differ with regard to their geometries impressed by the adjustable die. This means that a green body is produced by means of the extruder in a substantially continuous extrusion, the geometry of which green body changes along the extrusion axis or along the longitudinal axis of the green body, which thus in particular has two segments, i.e. the first functional segment and the second functional segment, which significantly differ with regard to their geometry.

As a result, the green body then already has, at least to some extent, almost all essential geometric shapes of the finished cutting tool, so that an elaborate post-processing of the green part and/or of the blank produced therefrom is in particular no longer necessary. This means that introducing material recesses, and thus removing significant amounts of material, can be dispensed with in the blank, for example, and only a finishing takes place as appropriate, in particular by grinding. By contrast, all larger material recesses are already realized on or in the green body during the extrusion, so that less extrusion material than was previously typical is needed for the production of the cutting tool.

According to the principle presented here, for example, a green body which has a functional segment which forms a tool shank in the finished cutting tool is thus produced. The corresponding functional segment of the green body already has, for example, a suitable cavity in such a way that the tool shank of the finished cutting tool is designed as a hollow shaft, whereby material is saved in comparison to a solid shaft, solid body, or full shaft. In this way, costs can then also be saved, among other things. Such a cavity additionally offers the advantage that a generous free space is already present over the shaft length of the finished cutting tool, in which free space a coolant can be guided, for example. If one or more cooling channels are then provided in the finished cutting tool, these are designed with reduced length since the aforementioned free space already forms a part of the coolant guide. This typically has a favorable effect on the flow of a cooling medium used, in particular when cooling channels with a relatively small diameter are provided or are to be realized.

With the aid of an aforementioned movable mold element, different, thus differently designed or differently dimensioned, green bodies can hereby in principle also be produced by means of a single extruder or extruder head in that the die of the extruder is adapted by moving the mold element to the respective type of green body that is to be subsequently produced. This principle is thereby considered to be an independent inventive approach and, accordingly, the submission of a separate application aimed thereat is expressly reserved. In such an instance, the mold element is preferably moved not during the extrusion of a green body, but rather before or after the extrusion of a green body or any number of a type of green body. In addition, both approaches can be combined with one another without problems and, for some application scenarios, both approaches are also combined with one another.

Independently of which of the two approaches is followed or whether a combination of both approaches is followed, the mold element is typically moved in such a way that at least one segment of the mold element is positioned within the extrusion channel before and/or after the movement. Furthermore, the mold element is typically transferred during the movement from a starting position into an end position, wherein in the event of the movement of the mold element this transfer takes place during the extrusion of a green body, in particular after the extrusion of the first functional segment and before the extrusion of the second functional segment of the green body following thereon in the direction of the extrusion axis. In some instances, the mold element effectively moves suddenly or abruptly so that a type of abrupt transition, for example an abrupt cross section reduction, is realized between the first functional segment and the second functional segment, without the extrusion process needing to be stopped or interrupted for this purpose. Alternatively, the mold element moves rather uniformly or continuously, for example in order to realize a smooth transition between the geometric designs of two successive functional segments. According to a further method variant, the mold element is moved synchronously, in particular synchronously with the extrusion material.

In a preferred development, the mold element is moved cyclically, periodically, or at regular time intervals. A corresponding repeating movement is in particular thereby used in order to produce multiple similar or substantially identical green bodies in succession, thus for example to extrude a type of endless strand with a repeating sequence of functional segments, which strand is then in particular divided at regular intervals in order to produce green bodies. In the endless strand, multiple green bodies are thus linked together at least until they are divided. However, a corresponding division typically already takes place in a region at the exit of the extruder, and namely in particular synchronously with the extrusion process, so that the term "endless strand" is rather suitable in that the extrusion process is not stopped after the extrusion of a green body and before the extrusion of a further green body.

According to an advantageous method variant, the mold element is moved further during extrusion in such a way that a tool shank, in particular a hollow shaft, and/or at least one flute and/or at least one cooling channel and/or a reduced cross section is or are hereby realized in a functional segment.

In the event of a reduced cross section, the green body then has a smaller cross section in the corresponding functional segment than in a functional cross section of the green body following thereon.

Particularly when a cutting tool is to be produced and a hollow shaft is realized in a functional segment, the wall thickness of the hollow shaft cannot be designed to be arbitrarily small or thin. In addition, a fixing possibility for fixing the finished cutting tool in a tool receptacle is normally to be realized at the end, and is therefore also realized in order, for example, to be able to fix the finished cutting tool by means of a stop screw of the tool receptacle or a stop bolt. Therefore, the hollow shaft preferably has a termination or closure at the end, or at least one material projection is realized on the inside of the hollow shaft.

In this instance, depending on the use case a corresponding flute, and in particular each flute, is furthermore formed as a straight flute or as a flute with a twist, thus as a flute which exhibits a helical or spiral course. In addition, the geometry and/or the depth of a corresponding flute, and/or the angle or pitch of a corresponding helical flute, is preferably variably predetermined for each green body or each type of green body, and/or is varied during the extrusion of a green body.

In particular if the geometry and/or the depth of a corresponding flute and/or the slope of a corresponding helical flute is to be varied during the extrusion of a green body, it is moreover advantageous if a (production) process control is realized in such a way that the geometry, in particular the surface geometry, of an already extruded part of the green body is determined or detected by means of sensors during the extrusion of a green body, and such that, based on the information thereby obtained, the movement or further movement of the mold element during the further extrusion of the green body is controlled in order to realize a predetermined geometry or surface geometry in the green body. In this way, the forming of a green body is thus monitored by means of sensors, for example. To this end, the geometry is, for example, detected by an optical scanning or measuring, and/or the slope of a helical flute is determined via a surface structure analysis. If necessary, a correction is then carried out during the forming of a green body via a suitable control and thus a suitable movement of the mold element.

Such a (production) process control is regarded as an independent inventive approach. Specifically, a combination of the features of the preamble of claim 1 with the features of the characterizing part of claim 15 is considered to be an independent invention. The submission of a separate application aimed thereat is expressly reserved.

It is moreover advantageous if the position, in particular the radial position, of each cooling channel, and/or the geometry of each cooling channel, and/or the diameter of each cooling channel is variably predetermined for each green body or each type of green body, and/or is varied during the extrusion of a green body. In this instance, a cooling channel is furthermore preferably arranged centrally. According to one design variant, the position and/or the geometry and/or the diameter of each cooling channel moreover follows the course of the geometry and/or the depth of a flute, and/or the slope of a helical flute, for example.

Particularly if a hollow shaft and/or at least one cooling channel is or are to be realized in the green body in a functional segment, during the extrusion the mold element is preferably moved along the extrusion axis of the extrusion channel, which typically corresponds to the central longitudinal axis of the extrusion channel. This means that the mold element is effectively moved back and forth in the extrusion channel, thus toward the extrusion channel outlet or away from the extrusion channel outlet. The mold element is then, for example, cylindrical in shape or has a cylindrical shape with indentations or notches, for example lateral grooves, in the cylinder shell. A corresponding basic cylindrical shape is in particular advantageous if a hollow shaft is to be formed herewith. The mold element is moreover preferably arranged centrally in the extrusion channel.

According to one advantageous development, the mold element has a substantially cylindrical nozzle insert which is located in the extrusion channel and is moved along the extrusion axis of the extrusion channel during the extrusion of the green body.

Alternatively, a corresponding hollow shaft can also be formed in that the extrusion material is driven against an auxiliary mold inserted into the extrusion channel in the direction opposite to the extrusion direction, which auxiliary mold is correspondingly intermittently inserted into the extrusion channel from the outside and fixed.

In some instances, the mold element, and in particular a mold element that can be moved along the extrusion axis, furthermore has a filament or is formed by an arrangement of multiple filaments. Such a filament or such filaments typically serve to form one or several cooling channels. Such a cooling channel is in this instance designed as a blind hole cooling channel or as what is known as a Y cooling channel with lateral outlet, for example. In some instances, both at least one blind hole cooling channel and at least one of what is known as a Y cooling channel are realized in a green body. In this instance, a corresponding filament typically has a fine, thread-shaped or spicular basic geometry and is formed by a wire, for example. Despite this often relatively filigree embodiment, such a filament is expediently at least dimensionally stable in such a way that the respective filament is substantially not deformed by the extrusion material driven through the extrusion channel. In addition, a corresponding filament has, or corresponding filaments have, for example, a round cross section or a non-round cross section, for example a trapezoidal cross section.

According to another embodiment, the cross section of such a filament changes, in particular gradually, along the longitudinal extent of the filament. Alternatively, the cross section of a corresponding filament is substantially constant over the entire longitudinal extent of the filament and/or has a thickening at the end, thus a thickening in the region of the free end. In an advantageous development, such a thickened free end is designed as an expandable or variably inflatable element and, for example, is formed from an elastic material so that the cross section or the diameter of a cooling channel produced therewith can herewith be variably predetermined. In this respect, it is in principle considered to be advantageous if the extent and/or the shape of a filament described herein and/or of a mold element described herein can be varied, and can thus be variably predetermined, so that its extent and/or its shape can be changed during the extrusion of a green body, for example.

As already explained above, such filaments serve in particular to realize cooling channels in the base body. In order to be able to variably predetermine their position in the radial direction, thus transversal to the extrusion axis, and/or in order to be able to vary their course along the longitudinal axis of the green body, such filaments and/or the mold element are preferably additionally movable or displaceable in the radial direction.

According to a further design variant, the mold element is alternatively or additionally designed to guide such a filament, which during the extrusion of the green body is then displaced relative to the mold element or to the remaining portion of the mold element in such a way that, for example, it at least intermittently and preferably only intermittently emerges with a free end from the mold element and reaches into the extrusion material. In this design variant in particular, the mold element is arranged in the extrusion channel, in particular centrally in the extrusion channel, and the free end of the filament, which is again preferably thread-shaped or spicular, is driven out of the mold element and into the surrounding extrusion material during the extrusion of the green part or green body.

A filament guided in this way in the mold element, or a corresponding number of filaments guided in the mold element, in turn serve in particular to form a cooling channel or a number of cooling channels. In this instance, a corresponding filament has, or the corresponding filaments have, for example, a round cross section or a non-round cross section, for example a trapezoidal cross section.

In a preferred development, the filament is or the filaments are guided in the mold element in such a way that the free end or the free ends are driven out of the mold element in a direction with a radial component or in the radial direction, and thus orthogonal to the extrusion axis. Lateral outlet openings or radially outwardly leading outlet openings for cooling channels in the green body are then realized in this way, for example. A number of what are known as Y cooling channels can in particular thus be produced thereby.

For this purpose in particular, the mold element is additionally preferably intermittently moved at the same velocity and in the same direction with the extrusion material in the extrusion channel, and during this a free end of a filament or the ends of a number of filaments are then, for example, moved once out of the mold element and into the mold element again in order to realize in precisely this way one or more circumferentially arranged openings for cooling channels in the green body, the shape of which cooling channels coincides with the cross-sectional shape of the filament or of the filaments.

According to a further design variant, during the extrusion the mold element is moved along a transverse axis transversal to the extrusion axis of the extrusion channel, or at least in a direction with a radial component. The mold element is in this instance in particular driven into the extrusion channel or pulled out of the extrusion channel, for example in order to realize an aforementioned cross section tapering or cross section reduction in a functional segment of the green body, and/or in order to realize one or several flutes, and/or in order to impress a torsion on the green body in a functional segment.

According to one embodiment, such a mold element movable along a transverse axis, or at least in a direction with a radial component, has a filament of the type described above at an end facing toward the extrusion channel, wherein this filament is additionally preferably driven by the movement of the mold element along the transverse axis, at least intermittently also in the direction of the extrusion axis, and thus effectively in a radial direction. This thus means that at least the free end of the filament is moved in the direction of the extrusion axis if the mold element is moved along the transverse axis. The corresponding free end then has a thickening described above, for example, or the thickness of the filament decreases, in particularly continuously, along its longitudinal extent starting from the free end. In the latter instance, a corresponding filament then, for example, has a kind of elongated conical shape.

Also advantageous is an embodiment in which a movable mold element, and in particular such a mold element movable along a transverse axis or at least in a direction with a radial component, is formed in the manner of a gouge or in the manner of a hollow needle. Such a mold element then not only occupies a spatial region so that it is effectively blocked for extrusion material; rather, extrusion material is therefore preferably removed and guided away in a targeted manner.

According to a further design variant, the mold element and/or a filament described above has a spiral geometry and/or a diameter varying, and in particular a continuously varying, in the direction of its longitudinal extent and/or in the direction of the extrusion axis. A cooling channel is then typically produced with the aid of such a mold element and/or of such a filament, wherein various diameters can be realized for the cooling channel via different positions of the mold element and/or of the filament in the direction of the extrusion axis, or a diameter varying along the cooling channel can be realized. The radial position of the cooling channel or its course in the radial direction can additionally or alternatively be varied via different positions in the radial direction, thus transversal to the extrusion axis.

According to another embodiment, the mold element is designed to not be rotationally symmetrical and, for example, is designed in the manner of a turbine blade. Such a mold element is then, for example, at least intermittently rotated about the extrusion axis during extrusion so that it performs a kind of rotational movement about the extrusion axis and hereby sets the extrusion material into rotation or twists it at least in sections.

An embodiment is also advantageous in which the extruder has a plurality of movable mold elements of the design variants described above, and in particular a plurality of different mold elements of the previously described design variants.

In this instance, the mold element is supplemented, for example, by a further movable mold element which also forms part of the die of the extruder and in particular forms, together with the other mold element, a type of mold element pair. In one design variant, the two mold elements of the mold element pair are in this instance arranged circumferentially at the extrusion channel, and in particular opposite each other circumferentially at the extrusion channel. In this instance, the two mold elements are then typically moved relative to the extrusion channel during the extrusion of the green body, wherein both movements are preferably opposite, and both movements more preferably take place, in particular simultaneously, along a common transverse axis transversal to the extrusion axis. According to one design variant, the mold elements of the mold element pair each have a previously described filament.

Depending on the intended use, it is furthermore advantageous if a mold element which is moved along the extrusion axis and/or transversal thereto is combined with at least one mold element or at least one previously mentioned mold element pair which is moved transversal to the extrusion axis, or at least in a direction with a radial component. According to another embodiment, two mold element pairs are additionally or alternatively combined in which one has filaments described above and one has no filaments.

As an alternative or in addition to the design variants described herein, a movable twist element is used in the extrusion of the green body, which twist element is arranged downstream of the extrusion channel in the extrusion direction, wherein the twist element is moved during the extrusion of the green body, in particular is rotated about the extrusion axis of the extrusion channel. This twist element serves in particular to impress a torsion on the green body in at least one functional segment. The degree of torsion in this instance is predetermined by the specification of the rotational speed of the twist element.

The use of a corresponding twist element is in this instance considered to be an independent inventive approach and, accordingly, the submission of a separate application aimed thereat is expressly reserved. A feature combination of the preamble of claim 1 with the features of claim 13 is in particular therefore considered to be an independent invention.

In the simplest instance, the twist element is designed in the manner of a hollow cylinder, wherein the inner shell surface of the twist element transmits a force to the extrusion material in the region of the twist element given a rotation of said twist element, as a result of which force the green body experiences a torsion.

The twist element or twist shell is alternatively or additionally designed in such a way that its diameter can be variably predetermined. The diameter can thus be adjusted, and in particular can also be changed during the extrusion of a green body. To this end, the twist element then has an expandable, wear-resistant membrane that is part of a hydraulic system, for example.

According to another design variant, as an alternative and in addition to a hollow cylinder geometry, the twist element has at least one inwardly directed projection, an inwardly directed nose, or an inwardly directed pin. Such an additional, effectively projecting element then typically engages in a flute already formed at least in one segment, as a result of which the cross section of the flute is maintained even when a torsion is impressed so that a previously straight flute effectively becomes a twisted flute.

The rotation speed of a corresponding twist element is further preferably synchronized with the extrusion speed, in particular in order to be able to subsequently realize any angles of twist at any time.

In this instance, a (production) process control is advantageous—in particular analogous to the manner described in the preceding—such that the angle of twist of an already extruded part of the green body is determined or detected by means of sensors during the extrusion of a green body, and such that the extruder, in particular the torsion of the emerging extrusion material, is controlled based on the information obtained thereby. A control of the extruder therefore in particular takes place depending on the detected angle of twist. Specifically, the rotation speed of the twist element is controlled in order to realize a predetermined angle of twist or angle-of-twist curve. Via this control it is ensured, for example, that introduced cooling channels and introduced flutes have the same angle of twist.

In this instance, the introduction of a test flute or marking within the course of the measuring method is preferably dispensed with. Instead, a completely contactless measuring method is preferably used in order to detect the surface structure. The angle of twist is then determined and controlled with the measurement data thus determined.

The (production) process control is in this instance considered to be an independent inventive approach and, accordingly, the submission of a separate application aimed thereat is expressly reserved.

A corresponding torsion can alternatively or additionally also be impressed in segments by at least one pin-like mold element with suitably formed free end, and/or by at least one mold element formed in the manner of a turbine blade, and/or by the corresponding segment being post-processed after emerging from the extruder, wherein the corresponding segment is, for example, brought between two flat bodies which are then moved relative to one another, given consistent distance between said two flat bodies, so that the two flat bodies are moved linearly counter to one another. This ultimately concerns the same principle according to which a baker rolls one end of a rolling pin on a flat working surface with the flat hand over the working surface while the other end is effectively held in place.

Moreover, a design variant is advantageous in which the green body is designed in one piece but is produced from at least two different extrusion materials, namely in particular in such a way that the green body has several segments when viewed in its longitudinal extent or in the longitudinal direction, which at least intermittently coincides with the extrusion axis, wherein each of these segments is produced from precisely one extrusion material or one type of extrusion material, and wherein different segments are produced from different extrusion materials or different types of extrusion materials. In this instance, a relatively high-quality and thus typically relatively expensive material is used for a segment that forms a cutting edge region, for example, whereas a less high-quality material is used for another segment. As an alternative or in addition thereto, different materials are not selected and used, or are not selected and used only for the purpose of optimizing costs, but are also or alternatively used for the purposes of use optimization.

An extruder designed for this purpose then has, for example, a slide control movable between two positions, which slide control releases one of two extruder material feed devices toward the extrusion channel depending on the position, wherein the slide control is shifted between the two positions at least once during the extrusion of the green body. In this way, a one-piece green body with segments made from two different extrusion materials can be produced via a displacement, and in particular via an abrupt displacement, of the slide control, without the extrusion process needing to be stopped or interrupted for this purpose.

The underlying principle in this instance is to be considered to be an independent invention and, accordingly, the submission of a separate application aimed thereat is expressly reserved. However, this principle can not only be implemented independently of the aforementioned design variants, but also can be advantageously combined with the aforementioned design variants, i.e., with any of the aforementioned design variants.

In each instance, it is furthermore advantageous if the slide control is moved cyclically or at regular time intervals in order to produce different functional segments of a green body made of different extrusion materials, for example. With the aid of the regular movement of the slide control, a one-piece green body is preferably produced, in which a first segment of a first functional segment is produced from a first extrusion material, and a second segment of the first functional segment is produced from a second extrusion material, and a first segment of a second functional segment is produced from the second extrusion material, and a second segment of the second functional segment is produced from the first extrusion material. The extrusion materials differ in their valence, for example.

Exemplary embodiments of the invention are explained in greater detail below on the basis of Figures.

BRIEF DESCRIPTION OF THE DRAWINGS

These respectively show simplified schematic illustrations of.

Figure 1:
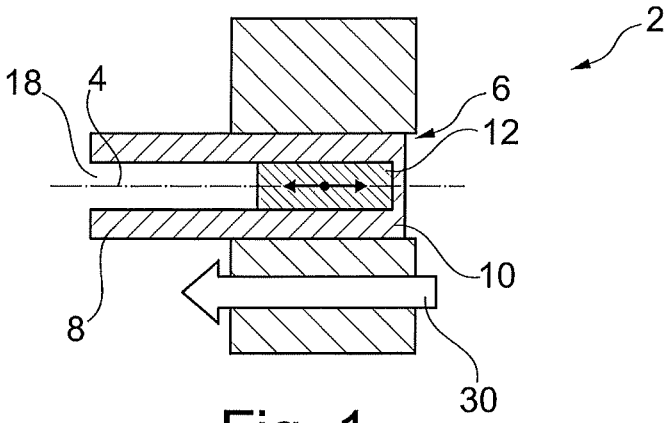
FIG. 1 a sectional view of a first embodiment of an extruder with a mold element and a partially produced green body, FIG. 2 a sectional view of a second embodiment of the extruder with a mold element and a partially produced green body, FIG. 3 a sectional view of a third embodiment of the extruder with a mold element and a partially produced green body, FIG. 4 a sectional view of a fourth embodiment of the extruder with three mold elements and a partially produced green body, FIG. 5 a sectional view of a fifth embodiment of the extruder with three mold elements and a partially produced green body, FIG. 6 a sectional view of a sixth embodiment of the extruder with five mold elements and a partially produced green body, FIG. 7 a sectional view of a seventh embodiment of the extruder with a mold element, a twist element, and a partially produced green body, FIG. 8 a perspective view of a first green body prior to a torsion, FIG. 9 a sectional view of an eighth embodiment of the extruder with five mold elements, a twist element, and a partially produced green body, FIG. 10 a sectional view of a second green body, FIG. 11 a rear view of the second green body, FIG. 12 a sectional view of a ninth embodiment of the extruder with five mold elements and a slide control in a first position, FIG. 13 a sectional view of the ninth embodiment of the extruder with five mold elements and the slide control in a second position, FIG. 14 a rear view of a third green body, FIG. 15 a rear view of a fourth green body, FIG. 16 a sectional view of a tenth embodiment of the extruder with four mold elements and a partially produced green body, FIG. 17 a sectional view of an eleventh embodiment of the extruder with a nozzle insert in a first position, FIG. 18 a sectional view of an eleventh embodiment of the extruder with a nozzle insert in a second position, FIG. 19 a sectional view of a twelfth embodiment of the extruder with a partially produced green body, FIG. 20 a sectional view of a thirteenth embodiment of the extruder with two mold elements and a partially produced green body, FIG. 21 a sectional view of a fourteenth embodiment of the extruder with two mold elements and a partially produced green body, FIG. 22 a sectional view of a fifteenth embodiment of the extruder with four mold elements and a partially produced green body, FIG. 23 a sectional view of a sixteenth embodiment of the extruder with two mold elements and a partially produced green body, FIG. 24 a sectional view of a seventeenth embodiment of the extruder with two mold elements and a partially produced green body, and FIG. 25 a sectional view of an eighteenth embodiment of the extruder with two mold elements and a partially produced green body.
Figure 2:
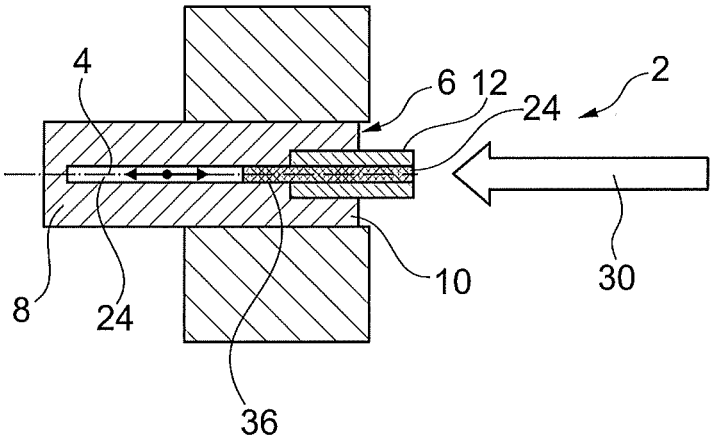
Figure 3:
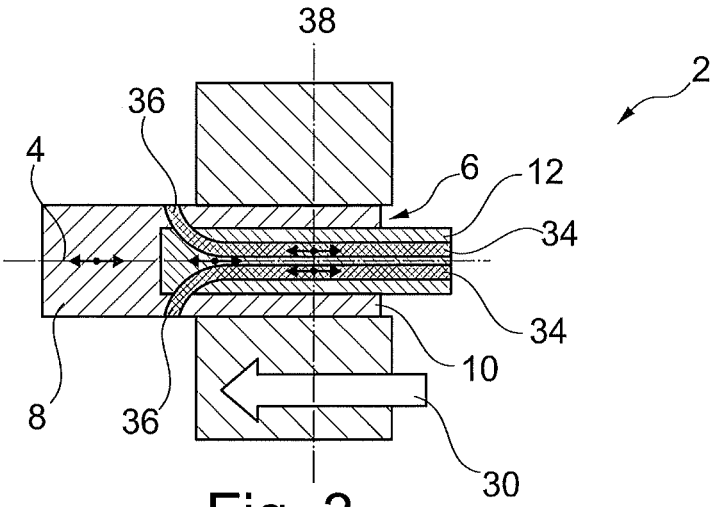
Figure 4:
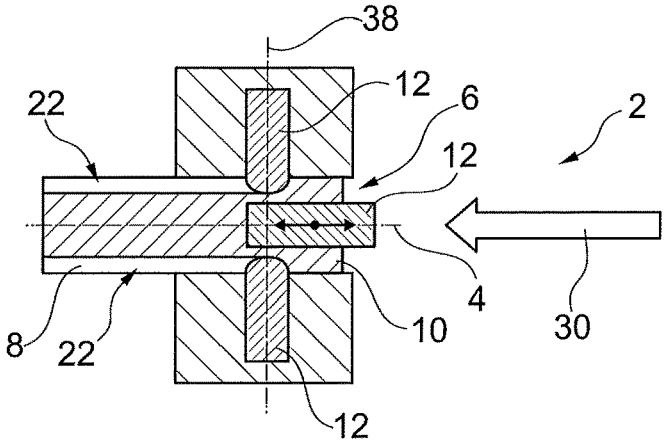

The terms used, in particular the designations of components and assemblies and the reference symbols used, are hereby introduced gradually, wherein reference is typically made to a selected Figure in various sections in each instance. Since most design variants have commonalities, thus for example a number of similar components, diverse embodiments in different sections of the description can be read or transferred among multiple figures. This also becomes evident in that parts having the same effect are provided with the same reference symbols in Figures.

DETAILED DESCRIPTION

A method described below by way of example serves to produce a blank, in particular a blank for the production of a cutting tool, thus for example a drill or a reamer. Within the course of the method, a green body 8 extending in the direction of the extrusion axis 4 is initially produced from extrusion material 10 by means of an extruder 2, which is shown in various design variants in FIG. 1 to FIG. 7, FIG. 9, FIG. 12, FIG. 13, and FIG. 16 to FIG. 25, and which has an extrusion channel 6 extending along an extrusion axis 4. The produced green body 8 is then typically subjected to a sintering process, and in some instances a finishing finally takes place, for example via grinding.

In this instance, the extrusion channel 6 together with a movable mold element 12 forms a die, effectively an adjustable die, of the extruder 2, and the mold element 12 is moved relative to the extrusion channel 6 during the extrusion of the green body 8. Via this movement, and thus the adjustment of the die, the shaping geometry of the die is changed so that the completely extruded green body 8 hereby has a first functional segment 14 and a second functional segment 16 adjacent thereto in the direction of the extrusion axis 4 or in the longitudinal direction of the green body 8, wherein the functional segments 14, 16 differ with regard to their geometries impressed by the die.

Figure 10:
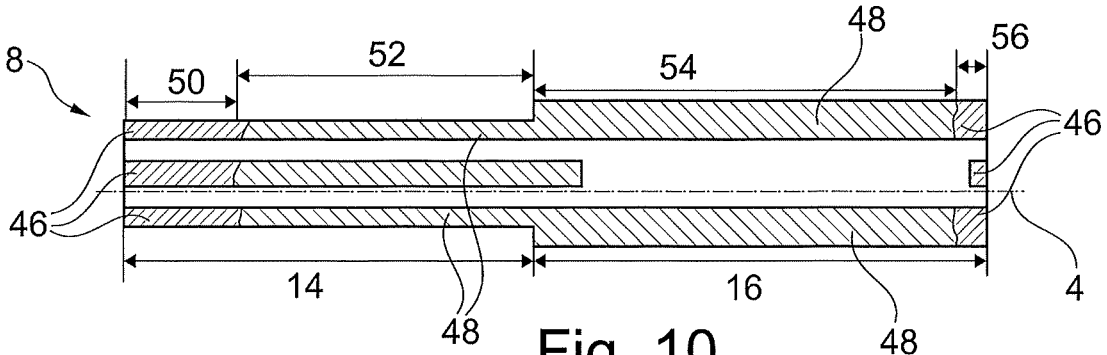
Figure 11:
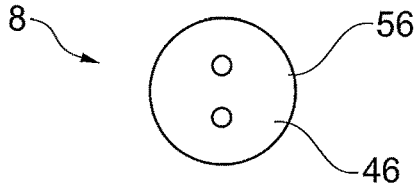
Figure 14:
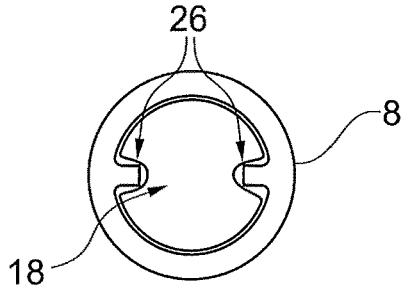
Figure 15:
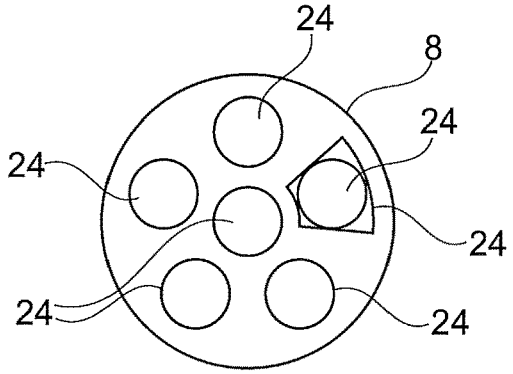
Figure 16:
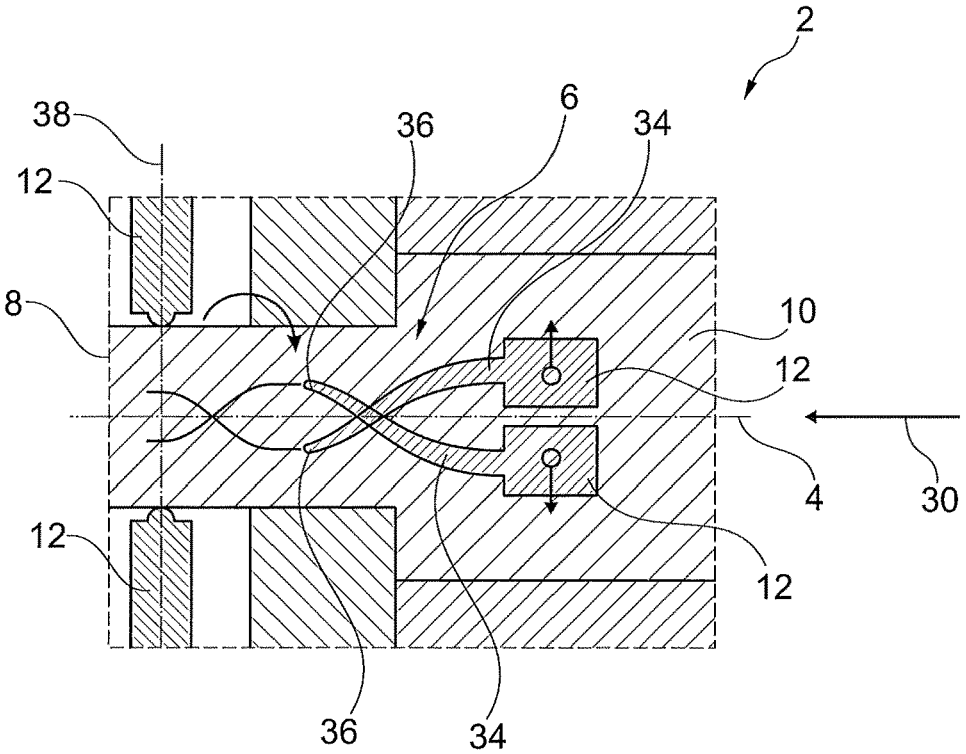
Figure 17:
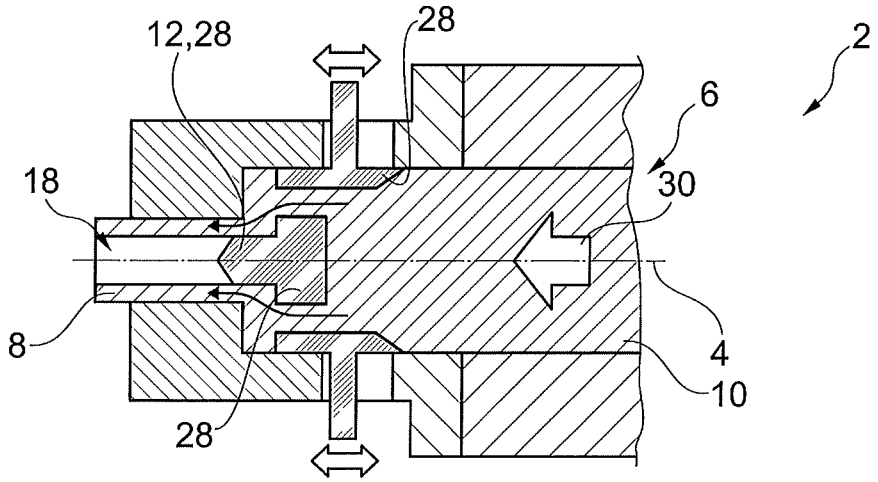
Figure 18:
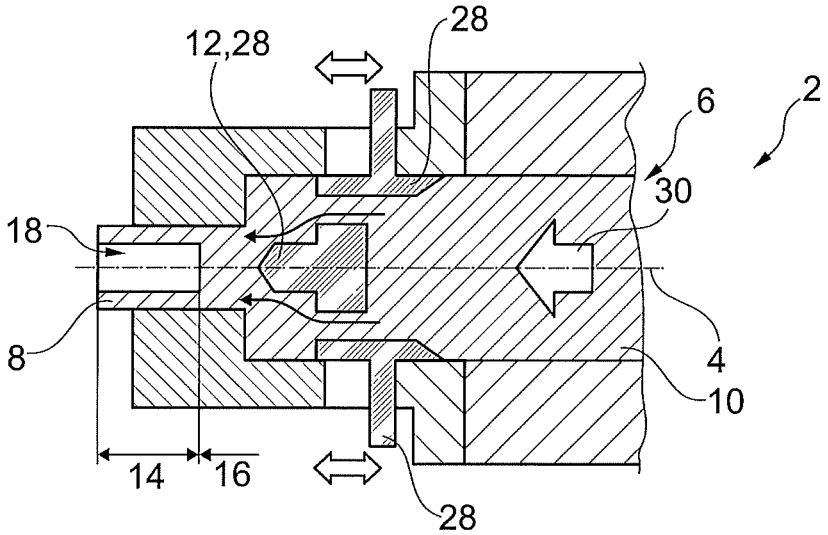

In this way, a hollow shaft 18 and/or a reduced cross section 20 and/or at least one flute 22 and/or at least one cooling channel 24 is then realized in the green body 8 in one of the functional segments 14, 16, for example. Typical in this instance in particular is an embodiment in which a reduced cross section 20, a number of flutes 22, and a number of cooling channels 24 are realized in the first functional segment 14 in comparison to the second functional segment 16, and in which a hollow shaft 18 is realized in the second functional segment 16 following thereon, which hollow shaft either is open at the end as indicated in FIG. 14 or is closed at the end as shown in FIG. 10, FIG. 11, and FIG. 15.

In particular for realizing a hollow shaft 18 and/or for realizing cooling channels 24, the mold element 12 is moved along the extrusion axis 4 during the extrusion of the green body 8 as indicated in FIG. 1, for example. The mold element 12 is in particular transferred from a starting position to an end position during the extrusion of the green body 8, and is typically transferred back into the starting position at a later point in time, wherein the mold element 12 produces a free space in the green body 8 in one of the positions, which free space then, for example, forms a hollow shaft 18 and/or a number of cooling channels, whereas the mold element 12 does not produce a corresponding free space in the other position. The position generating a free space is reproduced in FIG. 1, for example.

The mold element 12 for creating a hollow shaft 18 furthermore has a cylindrical shape, for example, and is preferably arranged centrally in the extrusion channel 6. According to another design variant, the mold element 12 has a cylindrical basic geometry, wherein projections and/or indentations are formed in the region of the cylinder jacket, for example in order to realize a cross section for the green body 8 as indicated in FIG. 14 in one of the functional segments 14, 16. A variant is shown here in which the green body 8 has elongated projections on the inside, which projections protrude into the hollow shaft 18.

In an advantageous development, the mold element 12 for creating a hollow shaft 18 and/or for creating a number of cooling channels 24 is designed as a kind of nozzle insert 28, in particular as a cylindrical nozzle insert 28, which is located in the extrusion channel 6 and is moved along the extrusion axis 4 during the extrusion of the green body 8. The nozzle insert 28 is in particular moved once before the beginning of the extrusion of one of the two functional segments 14, 16 and once at the end of the extrusion of the corresponding functional segment 14, 16, and is thereby preferably moved back and forth between a starting position and an end position. This situation and the two positions are reproduced in the illustrations of FIG. 17 and FIG. 18.

Figure 19:
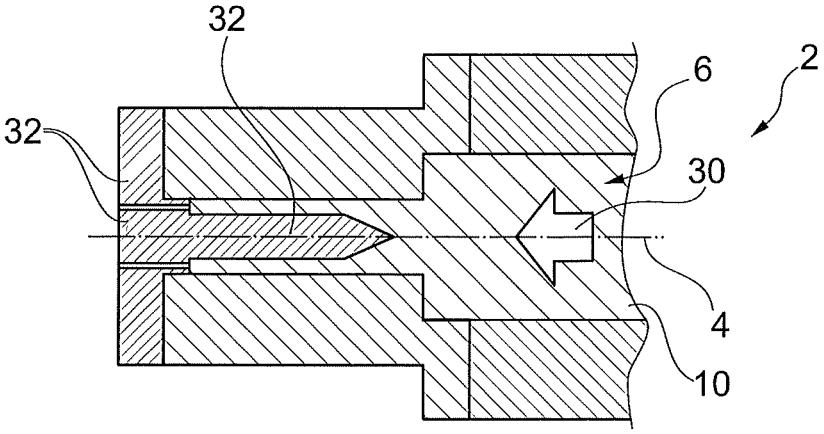

Alternatively, a corresponding hollow shaft 18 is produced in that the extrusion material 10 in is driven in the extrusion direction 30 against an auxiliary mold 32 inserted into the extrusion channel 6 in the direction opposite the extrusion direction 30. This auxiliary mold 32 is then removed again after forming the hollow shaft 18. The situation with inserted auxiliary mold 32 is shown in FIG. 19.

According to another design variant, the mold element 12 has at least one filament 34 and/or is designed to guide a corresponding filament 34, in particular in order to form a number of cooling channels 24. A corresponding filament 34 is typically of spicular or thread-shaped design. Nevertheless, such a filament 34 has a dimensional stability such that the corresponding filament 34 is substantially not deformed by the extrusion material 10 driven through the extrusion channel 6. Depending on the use case, such a filament 34 furthermore has a cross section changing along the longitudinal extent of the filament 34, thus for example a cross section that continuously increases starting from one free end 36 of the filament 34, as is the case in the instance of the two filaments 34 according to FIG. 16.

In this way, by displacing the filament 34 or the filaments 34 during the extrusion of the green body 8 along the extrusion axis 4, it can be predetermined not only whether this filament or these filaments produce a free space or free spaces in order to form a cooling channel 24 or cooling channels 24 but rather, depending on the position of the filament 34 or the filaments 34 in the extrusion channel 6, also what diameter the respective free space or the respective free spaces have. This means, that in the instance of the exemplary embodiment according to FIG. 16, the cross sections of the two cooling channels 24 are larger the further that the filaments 34 are positioned in the direction of the outlet opening of the extrusion channel 6. As an alternative or in addition to this, the position of the cooling channels 24 can also be variably predetermined in that a radial position is individually predetermined for each filament 34 via a radial displacement transversal to the extrusion axis 4 of the respective filament 34.

In principle, in this instance the number of filaments 34 varies depending on the intended use, and/or the cross-sectional shape of the filaments 34 is adapted to the respective intended use. Thus, as indicated in FIG. 15, in some instances round cross sections are provided and, for example, trapezoidal cross sections are provided in other instances.

As already mentioned above, in some instances the mold element 12 does not simply have only one or a plurality of filaments 34, but rather is designed to guide a filament 34 or a plurality of filaments 34. In this instance, the filament 34 is or the filaments 34 are then displaced relative to the mold element 12 during the extrusion of the green body 8 so that the filament 34 at least intermittently emerges with one free end 36, or the filaments 34 at least intermittently emerge with respectively one free end 36, from the mold element 12 and reaches or reach into the extrusion material 10. Such a design variant is reproduced in the illustrations of FIG. 2 and FIG. 3, for example. In the instance of the exemplary embodiment of FIG. 3, the two filaments 34 are thereby guided in the mold element 12 in such a way that the free ends 36 are driven out of the mold element 12 in a direction with a radial component in order to in this way form openings of cooling channels 24 that are formed laterally or circumferentially at the green body 8.

Particularly in the instance of this exemplary embodiment, the mold element 12 is moved together with the extrusion material 10 in the extrusion channel 6 at the same velocity and in the same direction, thus in the extrusion direction 30, at least intermittently during the extrusion of the green body 8. In particular in the instance of the exemplary embodiment according to FIG. 3, during this movement the free ends 36 of the two filaments 34 are additionally further preferably moved once out of the mold element 12 and into it again in order to ensure that the free ends 36 produce openings of the cooling channels 24, the cross section of which corresponds to the cross section of the free ends 36 of the filaments 34.

Alternatively or in addition to the previously described exemplary embodiments, the extruder 2 has a mold element 12 which is moved in a direction with a radial component, and in particular along a transverse axis 38 transversal to the extrusion axis 4 of the extrusion channel 6, during the extrusion of the green body 8. A corresponding exemplary embodiment is reproduced in FIG. 4, for example. The mold element 12 is, for example, driven into the extrusion channel 6 or pulled out of the extrusion channel 6, in particular in order to realize a reduced cross section 20 and/or at least one flute 22.

Such a mold element 12 movable along the transverse axis 38 is typically supplemented by a further movable mold element 12 which also forms part of the die of the extruder 2, such that a mold element pair is formed, for example. The two mold elements 12 of the mold element pair are in this instance preferably arranged circumferentially opposite each other at the extrusion channel 6. Furthermore, the two mold elements 12 of the mold element pair are preferably moved simultaneously and in particular along a common transverse axis 38, wherein the movements are usually opposite so that the two mold elements 12 of the mold element pair move toward or away from one another.

Figure 20:
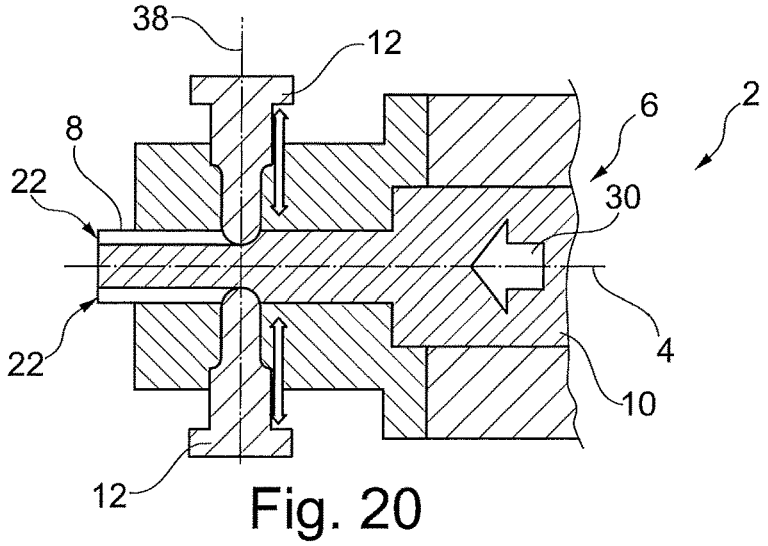
Figure 21:
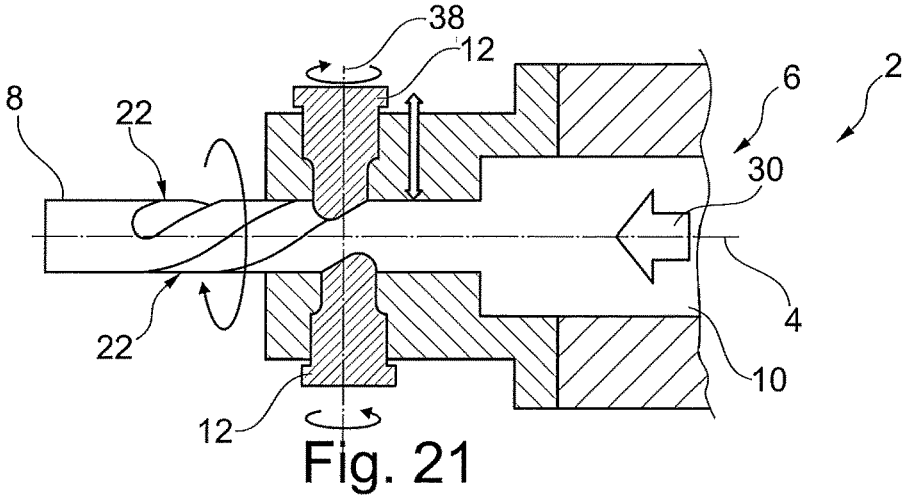

If two flutes 22 are to be produced with the aid of the mold elements 12 of a mold element pair, it is furthermore advantageous if the two mold elements 12 of the mold element pair are designed to be pin-shaped as indicated in FIG. 20, for example, and respectively have an end protruding into the extrusion channel 6 and having a hemispherical shape. In this way, two straight flutes 22 can then be realized in one of the two functional segments 14, 16. By contrast, if helical flutes 22 are to be formed with the aid of the mold element 12 of the mold element pair, mold elements 12 are used whose ends have a deviating shape, for example as indicated in FIG. 21. In this exemplary embodiment, it is moreover advantageous if the mold elements 12 of the mold element pair are rotatable about their respective longitudinal axis as indicated. With the aid of these mold elements 12, a torsion is then impressed on the green body 8 in the corresponding functional segment 14, 16.

Moreover, a not explicitly shown embodiment is also advantageous in which at least one mold element 12, and in particular both mold elements 12 of the mold element pair, is or are formed in the manner of a gouge or in the manner of a hollow needle. With such mold elements, not only are spatial regions then occupied so that they are effectively blocked for the extrusion material, but rather extrusion material is thus preferably removed and guided away in a targeted manner while the extrusion material is driven in the extrusion direction 30.

Figure 23:
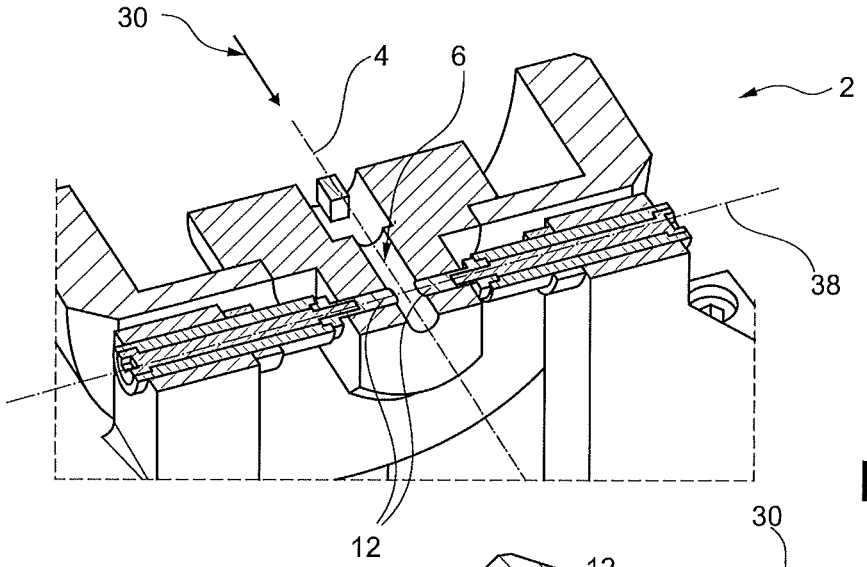
Figure 24:
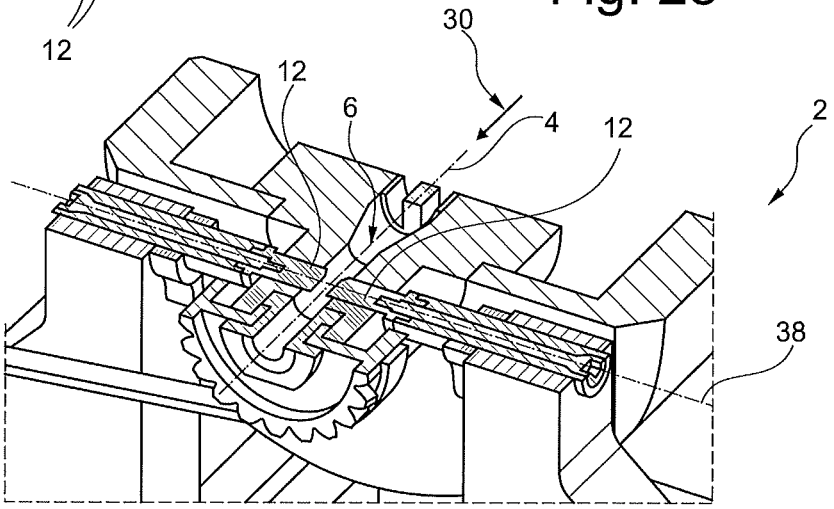
Figure 25:
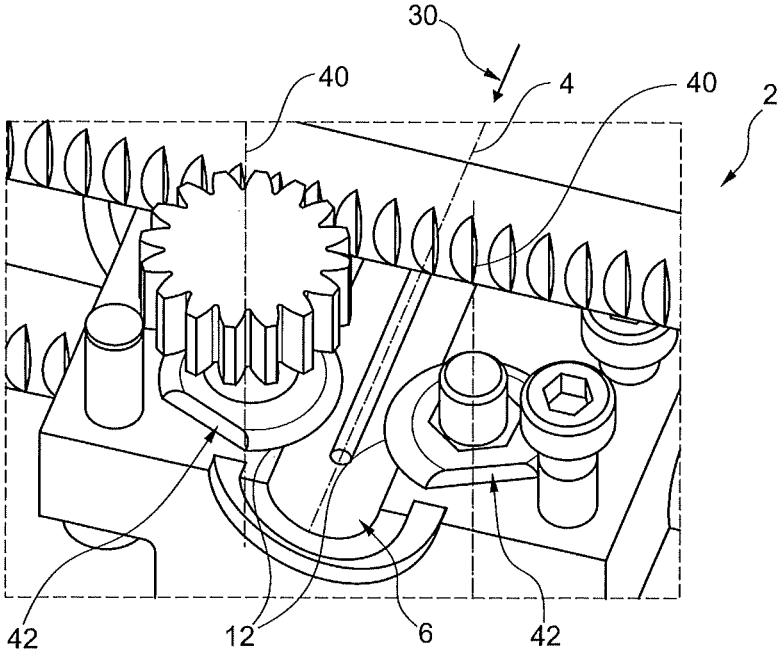

Further design variants of a mold element pair made of two mold elements 12 for forming two flutes 22 are shown in the illustrations of FIG. 23 to FIG. 25, for example. While the two mold elements 12 of the mold element pair are designed to be pin-shaped and linearly movable along the longitudinal axis in the instance of the exemplary embodiments according to FIG. 23 and FIG. 24, in the exemplary embodiment according to FIG. 25 the mold elements 12 have a ring shape or disk shape and are respectively rotatable about an axis of rotation 40. In this instance, each ring-shaped mold element 12 has a flat portion 42 which is always rotated in the direction of the extrusion channel 6 via a rotation of the mold elements 12 about the axes of rotations 40 when no flutes 22 are to be formed.

Figure 5:
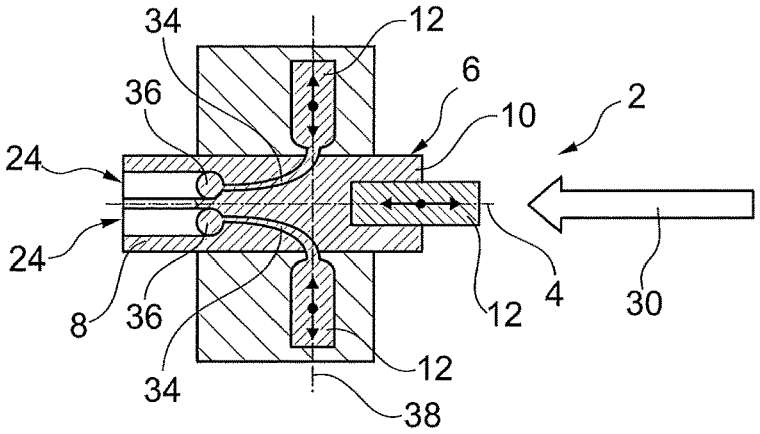

According to another design variant, a mold element movable in a direction with a radial component or along the transverse axis 38 has a filament 34 of the type described above or a filament 34 with a thickening at the end as reproduced in FIG. 5, for example. In this instance, the free end 36 of the filament 34 is preferably moved along the extrusion axis 4 if the mold element 12 is moved along the transverse axis 38. For this, a corresponding filament 34 then has a certain flexibility so that it can be deformed by a guide in the extruder 2 but not by the extrusion material 10.

Figure 7:
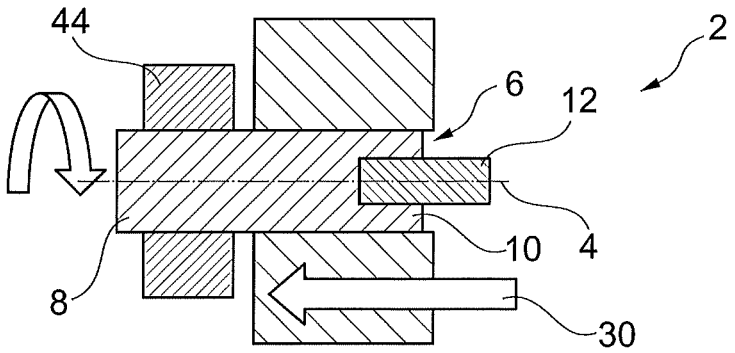
Figure 22:
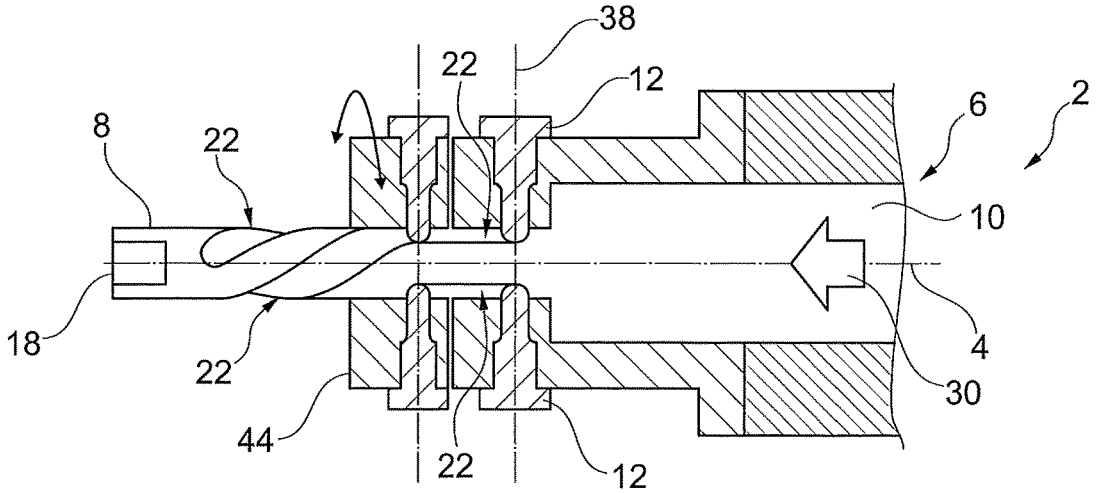

According to a further design variant, a movable twist element 44 is additionally or alternatively arranged downstream of the extrusion channel 6 in the extrusion direction 30, wherein the twist element 44 is moved during the extrusion of the green body 8 and in particular is rotated about the extrusion axis 4 of the extrusion channel 6. A torsion is then hereby impressed on the green body in at least one of the functional segments 14, 16. This situation is shown in FIG. 7, for example. For example, such a twist element 44 is in this instance designed in a hollow cylinder shape, for example as indicated in FIG. 7, or has a cylindrical basic geometry with additional pins as shown in FIG. 22, for example. The additional pins engage in the still-straight flutes 22 and prevent a cross section deformation of the flutes 22 during the impression of a torsion.

Figure 8:
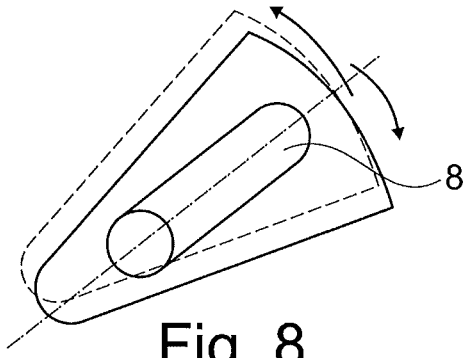

Alternatively, a corresponding torsion can also be impressed subsequently via a post-processing in that, for example, the corresponding functional segment 14, 16 is positioning between two flat bodies which execute a type of shearing movement at a constant distance. This approach is indicated in FIG. 8.

Figure 6:
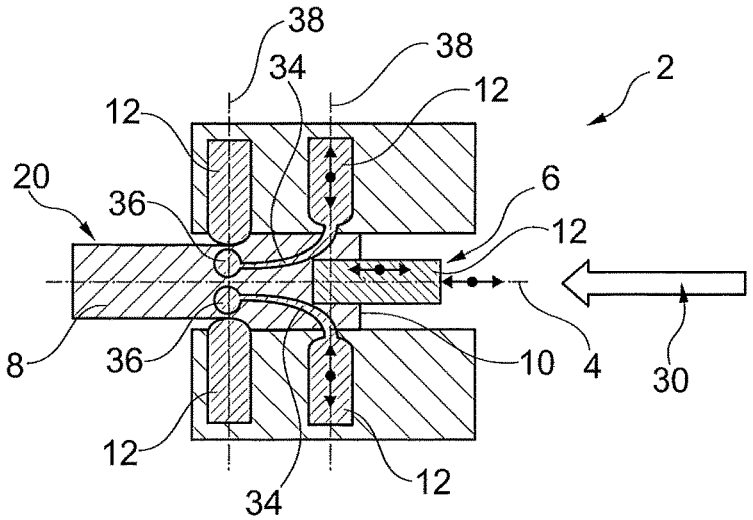
Figure 9:
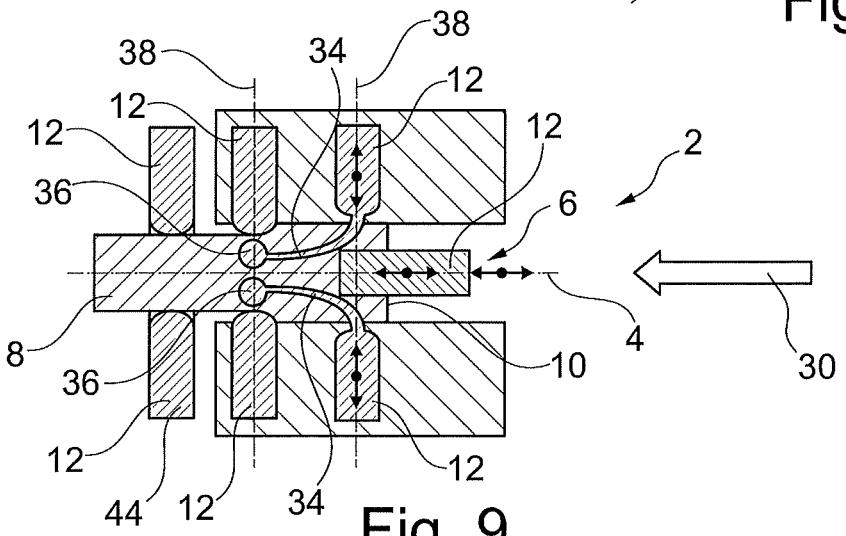

The mold elements 12 described above are combined with each other in diverse ways depending on the intended use, wherein the illustrations according to FIG. 6 and FIG. 9 reproduce two further design variants.

As an alternative or in addition to the method variants described above, a one-piece green body 8 that is manufactured from at least two different extrusion materials 46, 48 is produced with the aid of the method. For example, a green body 8 is produced in which, as viewed along the extrusion axis 4, the first functional segment 14 is formed by means of a first extrusion material 46, and in which the second functional segment 16 is realized by means of a second extrusion material 48.

A one-piece green body 8 depicted in FIG. 10 and FIG. 11 is preferably further produced in which a first segment 50 of the first functional segment 14 is produced from the first extrusion material 48, in which a second segment 52 of the first functional segment 14 is produced from the second extrusion material 48, in which a first segment 54 of the second functional segment 16 is produced from the second extrusion material 48, and in which a second segment 56 of the second functional segment 16 is again produced from the first extrusion material 46. In this exemplary embodiment, the first extrusion material 46 is of higher quality and, after completion, the finished cutting tool has a higher durability, in particular a higher hardness, in the segments 50, 56 which are produced from the first extrusion material 46. At least one cuffing edge is then, for example, positioned in the first segment 50 of the first functional segment 14 in the finished cuffing tool.

The fact that the second segment 56 of the second functional segment 16 is at least preferably also produced from the second extrusion material 48, which is typically of higher quality, is due to the fact that, preferably in the instance of all previously mentioned method variants, a continuous extrusion process is provided in which a type of endless strand emerges from the extrusion channel 6, which endless strand is then divided at regular intervals to finish the green body 8. The severing typically takes place at the end of each second functional segment 16 of a green body 8 which is adjoined in the endless strand by a first functional segment 14 of a further green body 8. Via the formation of the second segment 56 of the second functional segment 16 from the first extrusion material 46, it is then ensured that the first segment 50 of the first functional segment 14 of each green body 8 is in each instance completely formed from first extrusion material 46.

Figure 12:
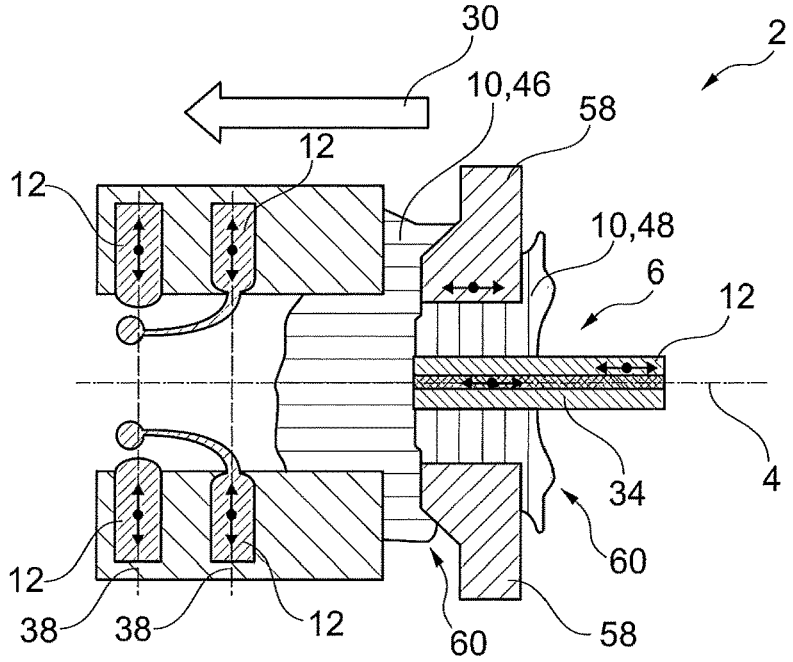
Figure 13:
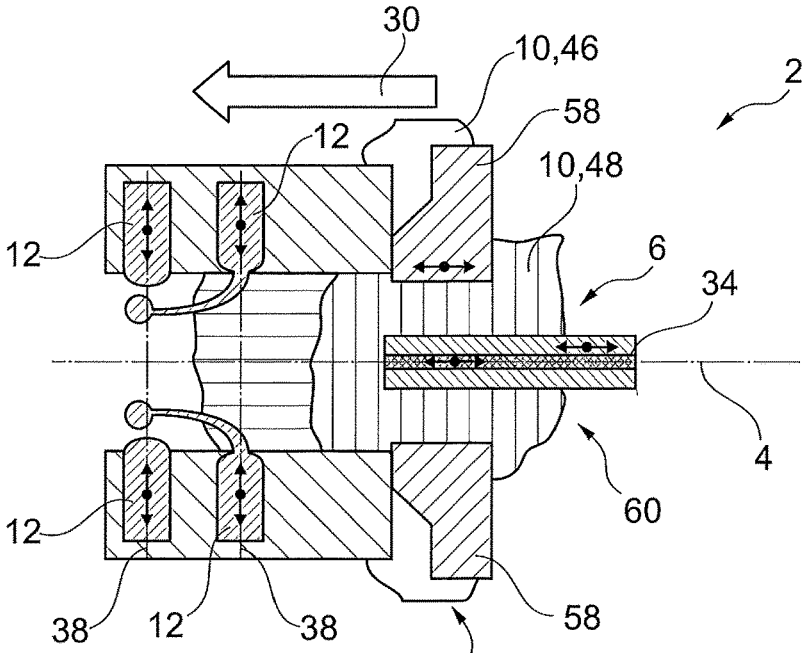

For the production of a green body 8 from two different extrusion materials 46, 48, it is advantageous if the extruder 2 has a slide control 58 which in particular can be moved between two positions and which, depending on the position, releases one of two extrusion material feed devices 60 toward the extrusion channel 6 so that subsequently only the extrusion material 46, 48 fed through this extrusion material feed device 60 is driven through the extrusion channel 6. The two positions are indicated in FIG. 12 and FIG. 13. During the extrusion of the green body 8, the slide control 58 is then brought into one of these positions in order to subsequently produce a section of the green body 8 from one of the extrusion materials 46, 48.

The invention claimed is:

1. A method for producing a blank for the production of a cutting tool in which a green body extending in the direction of an extrusion axis is produced from extrusion material by means of an extruder that has an extrusion channel extending along the extrusion axis, wherein the extrusion channel, together with a movable mold element, form an adjustable die of the extruder, the method comprising:

moving the first movable mold element relative to the extrusion channel and within said extrusion channel during the extrusion of the green body, wherein the first movable mold element is moved during the extrusion of the green body so that, as a result, the extruded green body has a first functional segment and a second functional segment following in the direction of the extrusion axis, wherein the first functional segment and the second functional segment have different geometries that are formed by the adjustable die, wherein the first movable mold element is moved in an orthogonal direction to the extrusion axis during the extrusion of the green body; and moving a second movable mold element along the extrusion axis of the extrusion channel during the extrusion of the green body, wherein the first movable mold element is configured to guide a filament that is moved relative to the first movable mold element during the extrusion of the green body so that said filament at least intermittently emerges with a free end from the first movable mold element and extends into the extrusion material.

2. The method according to claim 1, wherein a hollow shaft is produced within the extrusion material during the extrusion of the green body.

3. The method according to claim 1, wherein the first movable mold element is moved during the extrusion of the green body in such a way that a reduced cross section, a hollow shaft, at least one flute, and/or at least one cooling channel is formed in one of the first and second functional segments.

4. The method according to claim 1, wherein the second movable mold element comprises a cylindrical nozzle insert located in the extrusion channel.

5. The method according to claim 1, wherein the free end of the filament emerges from the first movable mold element in a direction with a radial component.

6. The method according to claim 1, wherein the first movable mold element and/or the filament is moved together with the extrusion material in the extrusion channel at the same velocity during the extrusion of the green body.

7. The method according to claim 1, wherein the first movable mold element has a filament at an end facing toward the extrusion channel, and in that, during the extrusion of the green body, a free end of the filament is driven in the direction of the extrusion axis of the extrusion channel.

8. The method according to claim 1, wherein the filament has a continuously varying diameter over the length of the filament.

9. The method according to claim 1, wherein a movable twist element is arranged downstream of the extrusion channel in the extrusion direction, and wherein the twist element is moved or rotated during the extrusion of the green body.

10. The method according to claim 1, wherein the geometry of an already extruded part of the green body is detected by one or more sensors during the extrusion of a green body, and in that, based on the information thereby obtained, the further movement of the first movable mold element during the further extrusion of the green body is controlled in order to produce a predetermined geometry of the green body.

11. The method according to claim 1, wherein the first movable mold element is rotated during the extrusion of the green body.

12. The method according to claim 1, wherein the first movable mold element has an end with a non-hemispherical shape.

13. A method for producing a blank for the production of a cutting tool in which a green body extending in the direction of an extrusion axis is produced from extrusion material by means of an extruder that has an extrusion channel extending along the extrusion axis, wherein the extrusion channel, together with a first movable mold element, form an adjustable die of the extruder, the method comprising:

moving the first movable mold element relative to the extrusion channel and within said extrusion channel during the extrusion of the green body, wherein the first movable mold element is moved during the extrusion of the green body so that, as a result, the extruded green body has a first functional segment and a second functional segment following in the direction of the extrusion axis, wherein the first functional segment and the second functional segment have different geometries that are formed by the adjustable die, wherein the first movable mold element is moved in an orthogonal direction to the extrusion axis during the extrusion of the green body; and moving a second movable mold element along the extrusion axis of the extrusion channel during the extrusion of the green body, wherein the green body is produced from two different extrusion materials, wherein the extruder has a slide control movable between two positions, wherein the slide control releases one of two extrusion material feed devices toward the extrusion channel depending on the position, and wherein the slide control is moved between the two positions during the extrusion of the green body.

14. An extruder for producing green bodies, comprising:

an extrusion channel extending along an extrusion axis and a first movable mold element, wherein the extrusion channel and the first movable mold element form an adjustable die configured for producing an extruded green body extending in the direction of the extrusion axis, wherein the first movable mold element is movable relative to the extrusion channel within the extrusion channel during the extrusion of the green body, whereby the first movable mold element of the adjustable die is moved so that the extruded green body has a first functional segment and a second functional segment following the first functional segment in the direction of the extrusion axis, wherein the first functional segment and the second functional segment have different geometries that are formed by the adjustable die, wherein the first movable mold element is moved in an orthogonal direction to the extrusion axis during the extrusion of the green body, wherein a second movable mold element is moved along the extrusion axis during the extrusion of the green body, and wherein the first movable mold element is configured to guide a filament that is moved relative to the first movable mold element during the extrusion of the green body so that said filament at least intermittently emerges with a free end from the first movable mold element and extends into the extrusion material.

15. The extruder according to claim 14, wherein a hollow shaft is produced within the extrusion material during the extrusion of the green body.

16. The extruder according to claim 14, wherein the first movable mold element is moved during the extrusion of the green body in such a way that a reduced cross section, a hollow shaft, at least one flute, and/or at least one cooling channel is formed in one of the first and second functional segments.

17. The extruder according to claim 14, wherein the second movable mold element comprises a cylindrical nozzle insert which is located in the extrusion channel and is moved along the extrusion axis of the extrusion channel during the extrusion of the green body.

18. A method for producing a blank for the production of a cutting tool in which a green body extending in the direction of an extrusion axis is produced from extrusion material by means of an extruder that has an extrusion channel extending along the extrusion axis, wherein the extrusion channel, together with a first movable mold element and a second movable mold element, form an adjustable die of the extruder, the method comprising: moving the first movable mold element relative to the extrusion channel and within said extrusion channel during the extrusion of the green body, wherein the first movable mold element is moved during the extrusion of the green body so that, as a result, the extruded green body has a first functional segment and a second functional segment following in the direction of the extrusion axis, wherein the first functional segment and the second functional segment have different geometries that are formed by the adjustable die, wherein the first movable mold element is moved in an orthogonal direction to the extrusion axis during the extrusion of the green body; and moving the second movable mold element along the extrusion axis of the extrusion channel during the extrusion of the green body, wherein the green body is produced from two different extrusion materials, wherein the extruder has a slide control movable between two positions, wherein the slide control releases one of two extrusion material feed devices toward the extrusion channel depending on the position, and wherein the slide control is moved between the two positions during the extrusion of the green body.

19. The method according to claim 18, wherein the first movable mold element is configured to guide a filament that is moved relative to the first movable mold element during the extrusion of the green body so that said filament at least intermittently emerges with a free end from the first movable mold element and extends into the extrusion material.

* * * * *